United States Patent [19]

Murdoch et al.

[11] 3,971,600

[45] July 27, 1976

[54] DRILL BIT

[75] Inventors: Henry W. Murdoch; Percy W. Schumacher, Jr., both of Houston, Tex.

[73] Assignee: Reed Tool Company, Houston, Tex.

[22] Filed: July 28, 1975

[21] Appl. No.: 599,817

[52] U.S. Cl. ..... 308/8.2

[51] Int. Cl.[2] ..... F16C 33/66

[58] Field of Search ..... 308/8.2, 135, 168, 235

[56] References Cited

UNITED STATES PATENTS

| | | | |
|---|---|---|---|
| 2,076,001 | 4/1937 | Reed | 308/8.2 |
| 2,104,819 | 1/1938 | Schlumpf et al. | 308/8.2 |
| 3,467,448 | 9/1969 | Galle | 308/8.2 |
| 3,746,405 | 7/1973 | Welton | 308/8.2 |

*Primary Examiner*—M. H. Wood, Jr.
*Assistant Examiner*—Gene A. Church
*Attorney, Agent, or Firm*—Jack R. Springgate

[57] ABSTRACT

A drill bit having a body with a shaft thereon, a roller cutter, an annular thrust bearing, means for connecting said roller cutter to the thrust bearing, means for retaining said thrust bearing on the shaft, and a lubrication system containing the thrust bearing and the retaining means with the lubrication system seal positioned between the outer edge of the roller cutter and the base of the shaft.

11 Claims, 5 Drawing Figures

DRILL BIT

BACKGROUND OF THE INVENTION

Early roller cutter rock bits did not have ball bearings to support the cutter on the shaft. Such bits utilized rings held on the shaft by a nut and such rings were externally threaded to receive the roller cutter thereon. The axial thrust was taken by the ring against the nut in one direction and against a washer or the body in the other direction. The H. R. Hughes U.S. Pat. Nos. 979,496, 1,010,144 and 1,124,445. Such structures did not provide sealed lubrication systems for the roller cutter. Further the application of a sealed lubrication system to such prior art structures would be very difficult as it would require multiple seals.

Recent rock bit designs have utilized ball bearings between the shaft and the cutter to absorb the thrust of the cutter. With such ball bearing designs the ball races are provided in the cutters and mating races are provided in the shafts. The surfaces of these races have been made hard to avoid surface fatigue problems. Carburizing grades of steel have been used for these rock bits but such steels have been found to be subject to cracking when hard metal inserts are used. A drill bit design which did not include a ball bearing would allow the use of medium carbon, through hardening, steels and thus avoid the cracking problem when hard metal inserts are used.

In such structures the portion of the body through which the balls are loaded into their race weakens the body and the journal.

SUMMARY

The present invention relates to an improved drill bit having a sealed lubrication system which utilizes an annular thrust bearing rather than a ball type bearing.

An object of the present invention is to provide an improved roller cutter drill bit which has an improved drilling life.

Another object is to provide an improved roller cutter drill bit which allows the roller cutter to be made of a medium carbon, through hardening, steel to eliminate the cracking problem when hard metal inserts are used.

A further object is to provide an improved roller cutter drill bit which avoids problems of thinness of the roller cutter.

Still another object is to provide an improved roller cutter drill bit which is simpler to machine and heat treat.

A still further object is to provide a bearing system for a roller cutter drill bit with a sealed lubrication system which does not rely on ball bearings for thrust and which has a simple seal between the roller cutter and the bit body.

BRIEF DESCRIPTION OF THE DRAWINGS

These and other objects and advantages of the present invention are hereinafter set forth and explained with respect to the drawings wherein.

DESCRIPTION OF THE PREFERRED EMBODIMENTS

Figure 1:
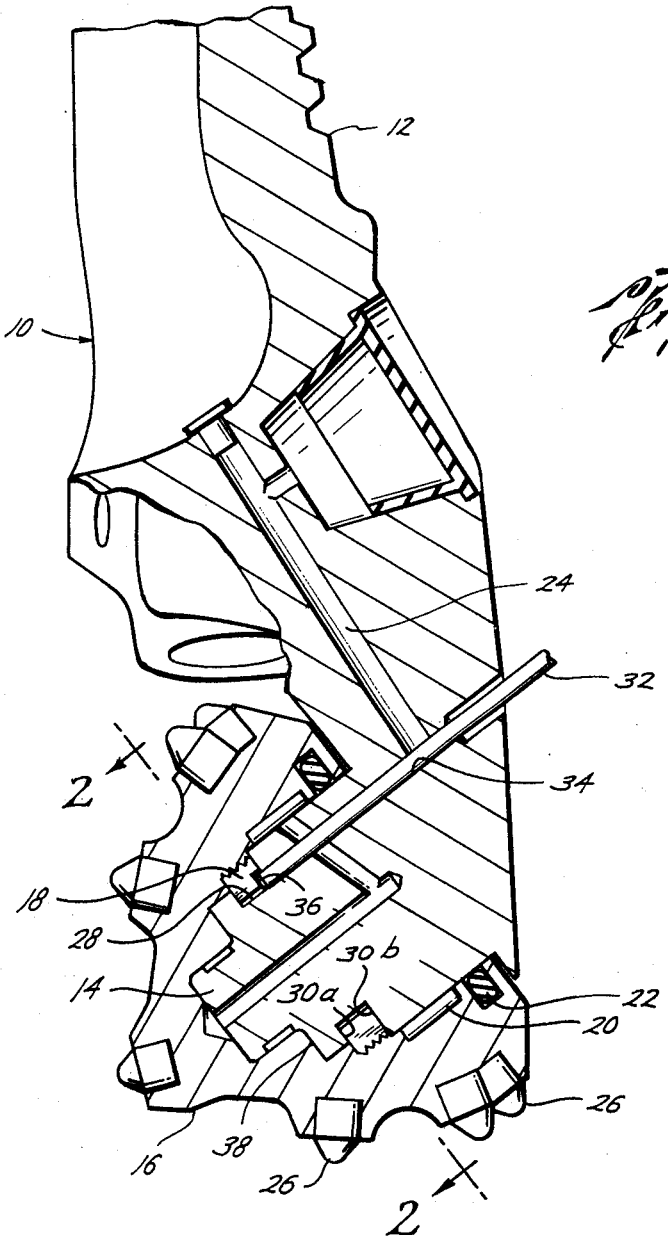
FIG. 1 is a partial view of a roller cutter drill bit showing the preferred form of the improved roller cutter and bearing of the present invention.

The drill bit 10 shown in FIG. 1 is a roller cutter type of drill bit and includes the body 12 (portions of which are not shown for purpose of clarity), the shaft 14 extending inwardly and downwardly and the roller cutter 16 suitably mounted on the shaft 14 as hereinafter explained. Such drill bits normally have one or more roller cutters supported on shafts extending from the drill bit body but for sake of clarity only one shaft and one cutter are shown.

Figure 2:
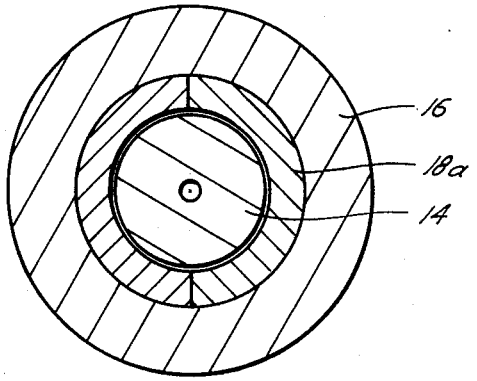
FIG. 2 is a sectional view taken along line 2—2 in FIG. 1.

In the preferred form of structure shown in FIGS. 1 and 2, the roller cutter 16 is mounted on shaft 14 with thrust bearing 18, bushing 20 and the seal 22 therebetween. Seal 22 prevents entry of detritus between the shaft 14 and the cutter 16 and seals the lubrication system 24. The cutter 16 is provided with hard metal inserts 26 suitably installed in the roller cutter 16.

Shaft 14 defines the groove 28 into which thrust bearing 18 is adapted to be positioned. Thrust bearing 18 is a split ring as best seen in FIG. 2. The two halves 18*a* and 18*b* of bearing 18, being semi-annular in shape, are positioned in the groove 28 between the shoulders 30(*a*) and 30(*b*). With the tool 32 positioned in opening 34 and notch 36 as shown, roller cutter 16 is threaded onto the exterior threads of thrust bearing 18. When assembled a suitable plug (not shown) is positioned within opening 34 after removal of tool 32 to seal the lubrication system.

The shoulders 30(*a*), 30(*b*) and 38 on shaft 14 are machined to provide the desired thrust surfaces for cutter 16. The distance between the thrust surfaces of shoulders 30(*b*) and 38 is preselected to provide a slight clearance so that the cutter 16 engages shoulder 38 before bearing ring 18 engages shoulder 30(*b*). Such clearance is preferred to be between 0.005 inch and 0.010 inch. Also the play of cutter 16 on shaft 14 is determined by the clearance of the ring 18 in the groove 28. Too large a space between shoulders 30(*a*) and 30(*b*) with respect to the width of bearing ring 18 is avoided so that the axial movement of roller cutter 16 on shaft 14 is minimized. Excessive axial movement of cutter 16 is detrimental to the life of seal 22.

It is preferred that the mating threads on thrust bearing 18 and roller cutter 16 be right-hand threads so that they will not loosen as the roller cutter turns in drilling using the normal clockwise drill bit rotation. Also suitable thread locking material may be used to prevent loosening of the cutter on the thrust bearing ring 18.

Figure 3:
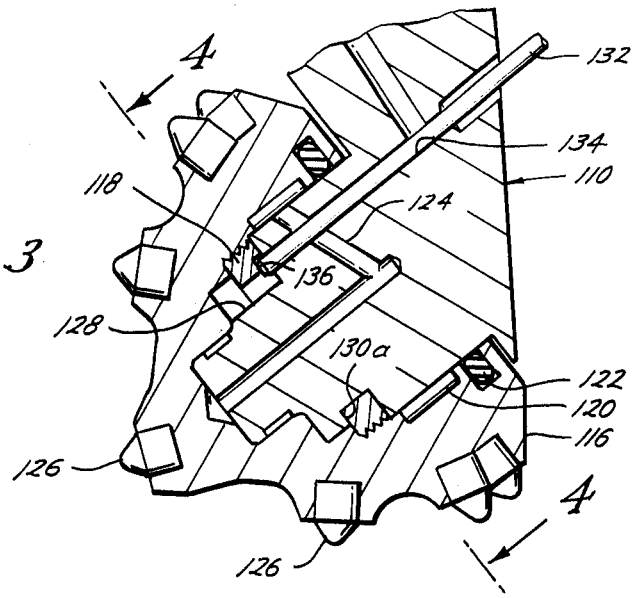
FIG. 3 is a sectional view of a modified form of roller cutter, shaft and bearing of the present invention.
Figure 4:
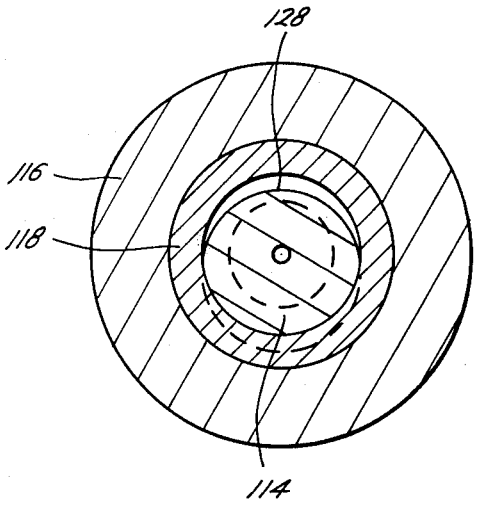
FIG. 4 is a sectional view taken along line 4—4 in FIG. 3.

In the modified form of structure illustrated in FIGS. 3 and 4 the drill bit 110 has a shaft 114 with the roller cutter 116 suitably mounted thereon as hereinafter explained. The structure includes the thrust bearing 118, the bushings 120 and the seal 122. Seal 122 prevents entry of detritus between shaft 114 and cutter 116 and seals the lubrication system 124. The cutter 116 is provided with hard metal inserts 126.

The shaft 114 defines an eccentric groove 128 into which the thrust bearing 118 is positioned. The eccentric shoulder 130(*a*) of the groove 128 has an outer diameter smaller than the inner diameter of the thrust bearing 118. Thus, the thrust bearing may be slipped over the end of the shaft 114 and positioned within the groove 128. With this structure the groove 128 and thrust bearing 118 may be made to minimize the axial tolerance or play between the roller cutter 116 and the shaft 114. The exterior of the thrust bearing 118 is threaded to be received within the mating threads within the roller cutter 116.

To assemble the structure, the tool 132 is inserted through the opening 134 in shaft 114. Thrust bearing 18 has a notch 136 on its inner surface to be engaged by the tool 132 as shown in FIG. 1. With the tool 132 preventing the thrust bearing 118 from rotating, the roller cutter 116 is threaded thereon. The mating threads on the thrust bearing 118 and the roller cutter 116 should be right hand threads so that they will not loosen as the roller cutter turns in drilling. Also suitable thread locking material may be used to prevent loosening of the threads. A plug (not shown) is set in opening 134 to seal the lubrication system. With roller cutter 116 locked on thrust bearing 118, the thrust bearing 118 is held against transverse movement by the engagement of bushing 122 by roller cutter 116.

Figure 5:
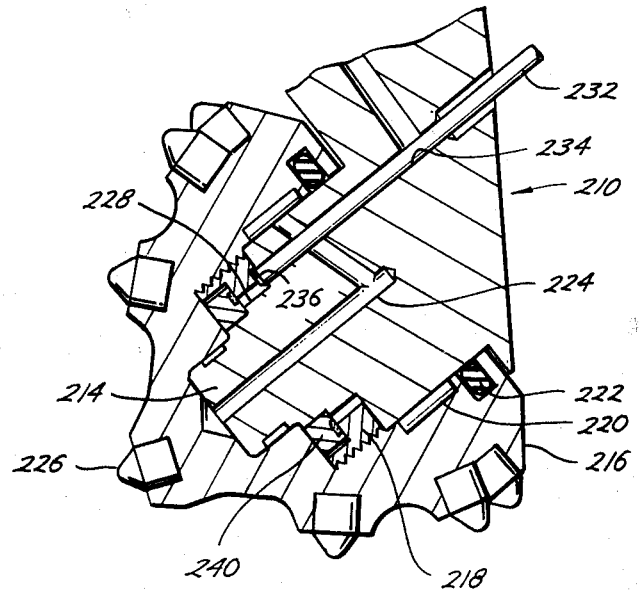
FIG. 5 is another sectional view of a modified form of roller cutter, shaft and bearing of the present invention.

In the other modified form of the present invention shown in FIG. 5 the drill bit 210 includes the shaft 214 with the roller cutter 216 suitably mounted thereon as hereinafter explained. The bushing 220 and the seal 222 are positioned in the roller cutter 216 as shown. Seal 222 prevents entry of detritus between the cutter 216 and the shaft 214 and seals the lubrication system 224. The thrust bearing 218 is positioned around the end of shaft 214 and then the collar 240 is press fit onto the shaft 214 to define the narrow groove 228 in which thrust bearing 218 is positioned. The collar 240 is suitably secured on shaft 214 as by electron beam welding or other suitable means. As in the other forms previously described the roller cutter 216 is threaded onto the exterior threads of thrust bearing 218 with the tool 232 extending through opening 234 and engaged within notch 236 to prevent rotation of the thrust bearing 218 during assembly. When assembled, the tool 232 is removed and a suitable plug positioned in opening 232 to seal the lubrication system.

From the foregoing it can be seen that the present invention provides an improved roller cutter drill bit in which the roller cutter may be made of medium carbon through hardening steel, the tolerances of movement of the cutter when installed on the shaft are minimized, is simple to machine and heat treat and avoids the problem of hard metal inserts being forced into the bearing area because of the foller cutter structure being too thin.

Also the opening in the body through which the tool is inserted functions as a part of the lubrication system. This hole is sufficiently small so that it does not appreciably weaken the body.

What is claimed is:

1. A drill bit, comprising a body having a shaft extending therefrom, a roller cutter having a hollow central portion, bearing means for rotatively mounting said roller cutter on said shaft with the outer edge of said roller cutter being in close spaced relationship to the base of said shaft, an annular thrust bearing secured within said cutter, means on said shaft for retaining said thrust bearing and said cutter in rotating position around said shaft, a lubrication system defined in said body and said shaft and communicating with said bearing means and said thrust bearing, and means sealing between the outer edge of said roller cutter and the base of said shaft whereby said bearing means and said annular thrust bearing and said retaining means are contained within the lubricated space between said roller cutter and said shaft.

2. A drill bit according to claim 1 wherein said retaining means includes a collar surrounding said shaft outwardly of said thrust bearing, and means for securing said collar to said shaft said collar having an outer diameter greater than the inner diameter of said thrust bearing.

3. A drill bit according to claim 1, wherein said retaining means includes an eccentric shoulder defined on said shaft, said eccentric shoulder having an outer diameter smaller than the inner diameter of said thrust bearing whereby said thrust bearing may be slipped over said shoulder and retained in position around said shaft by said shoulder.

4. A drill bit according to claim 1, wherein said thrust bearing is threaded into said roller cutter.

5. A drill bit according to claim 4 including an accessway defined through said shaft to communicate with said thrust bearing to retain said thrust bearing in place as said cutter is threaded thereon.

6. A drill bit according to claim 5 wherein said accessway provides a portion of the communication of said lubrication system.

7. A drill bit according to claim 1 wherein said retaining means includes an annular collar secured to said shaft after said thrust bearing has been installed thereon, said collar being sufficiently large in diameter to provide a shoulder retaining said thrust bearing in its position on said shaft.

8. A drill bit according to claim 7, wherein said collar is secured to said shaft by welding.

9. A drill bit according to claim 1, wherein said shaft defines a groove near its outer end, and said thrust bearing is a split ring formed of two half rings positioned in said groove.

10. A drill bit according to claim 1, wherein said shaft and said retaining means each define a thrust surface against which said thrust bearing engages when said roller cutter is subjected to axial loads.

11. A drill bit according to claim 10, wherein the space between said thrust surfaces on said shaft and on said retaining means is only slightly greater than the axial dimension of said thrust bearing whereby said roller cutter is supported on said shaft with a minimum of axial movement.

* * * * *